US007343720B2

(12) United States Patent
Brown

(10) Patent No.: US 7,343,720 B2
(45) Date of Patent: Mar. 18, 2008

(54) CAPPING DEVICE WITH QUICK RELEASE MECHANISM AND METHODS OF RELEASING AND RE-CONNECTING

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 0 days.

(21) Appl. No.: 11/538,715

(22) Filed: Oct. 4, 2006

(65) Prior Publication Data

US 2007/0084151 A1 Apr. 19, 2007

Related U.S. Application Data

(60) Provisional application No. 60/723,390, filed on Oct. 4, 2005.

(51) Int. Cl.
*B65B 7/28* (2006.01)

(52) U.S. Cl. ..... 53/331.5; 53/317

(58) Field of Classification Search ..... 53/331.5
See application file for complete search history.

(56) References Cited

U.S. PATENT DOCUMENTS 3,031,822 A 5/1962 Dimond
4,267,683 A * 5/1981 Harrington ..... 53/331.5
5,417,031 A 5/1995 Bankuty et al.
6,170,232 B1 * 1/2001 VandeGeijn ..... 53/331.5
6,840,024 B2 * 1/2005 Ronchi ..... 53/329
6,945,011 B2 * 9/2005 Hidding et al. ..... 53/167
2001/0054273 A1 * 12/2001 Gruson ..... 53/331.5
2005/0098230 A1 * 5/2005 Stavrakis et al. ..... 141/144

OTHER PUBLICATIONS

European Application No. EP 06020818; Search Report dated Nov. 30, 2006; Search Report mailed Dec. 18, 2006.

* cited by examiner

*Primary Examiner*—John Sipos
(74) *Attorney, Agent, or Firm*—Howard & Howard Attorneys, P.C.

(57) ABSTRACT

A capping device fits caps onto containers by applying an axial force to the caps as they are threaded onto the containers. The capping device utilizes a spindle rotatable about an operational axis for imparting rotation to a capper unit. A connector coupled to the capper unit is releasably coupled to the spindle by a quick release mechanism. The quick release mechanism is normally biased in the locked position and is configured to automatically move from the unlocked position back to the locked position when the connector mates with the spindle as a user re-connects the capping unit back to the spindle. Methods of releasing and re-connecting the capping unit to the spindle are also disclosed.

19 Claims, 11 Drawing Sheets

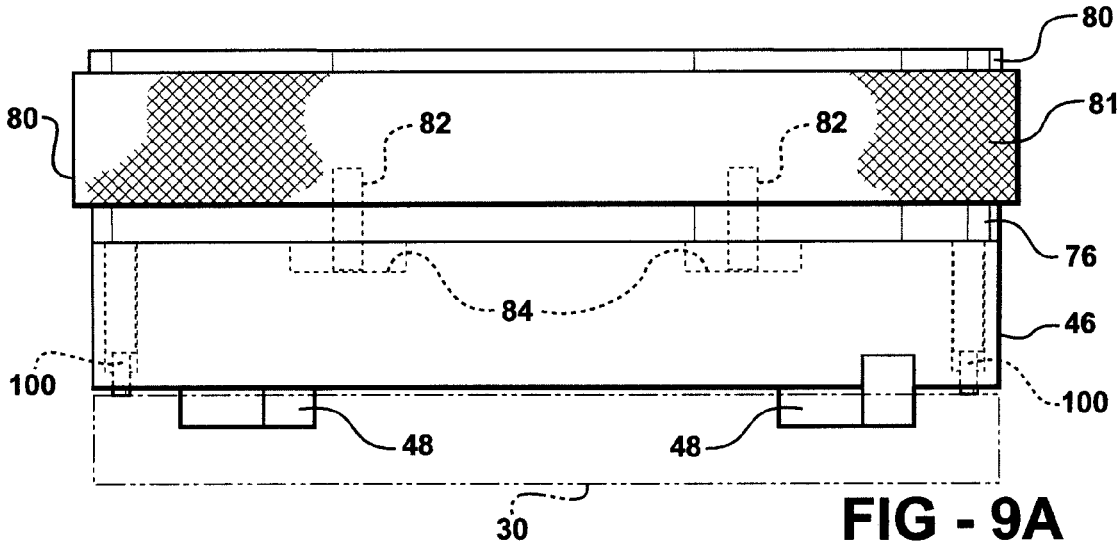
FIG - 9A
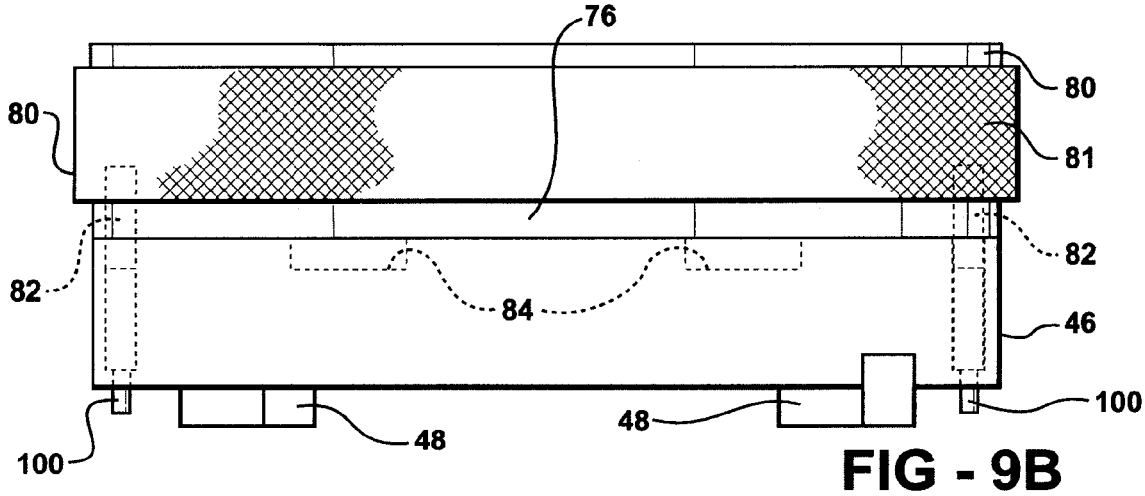
FIG - 9B
FIG - 10A
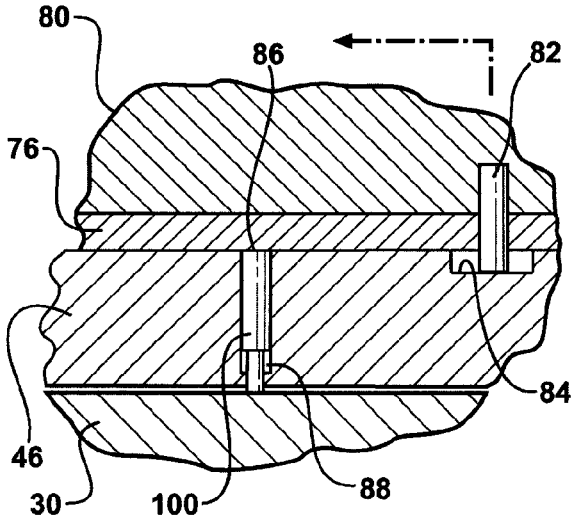

CAPPING DEVICE WITH QUICK RELEASE MECHANISM AND METHODS OF RELEASING AND RE-CONNECTING

RELATED APPLICATIONS

This application claims the benefit of U.S. Provisional Patent Application Ser. No. 60/723,390, filed on Oct. 4, 2005, the advantages and disclosure of which are hereby incorporated by reference.

FIELD OF THE INVENTION

The present invention generally relates to a capping device for fitting caps onto containers, particularly beverage containers. More specifically, the present invention relates to the capping device having a quick release mechanism for quickly and easily connecting and disconnecting a capping unit to and from a spindle of the capping device.

BACKGROUND OF THE INVENTION

Capping machines typically utilize multiple capping devices, also known as capping heads or headsets, for fitting pre-threaded caps onto containers to secure contents disposed inside the containers. A typical capping device includes a spindle operatively coupled to a drive source such as a drive motor or turret assembly to impart rotation to the spindle. A capping unit is coupled to the spindle via a connector such that the capping unit rotates with the drive member. The capping unit typically includes a cap-engaging portion and a torque dependent clutch that limits the amount of torque transmitted to the cap as the cap is threaded on the container. In some systems, it is necessary to intermittently service the capping unit and/or change out the capping unit for different applications. Release mechanisms are employed to release the capping unit from the spindle.

For instance, in U.S. Pat. No. 6,840,024 to Ronchi, a capping device has a first part fixed to the spindle for rotating with the spindle about an operational axis. A second interchangeable part is releasably coupled to the first part by a release mechanism. The release mechanism includes a pair of opposing L-shaped recesses defined in the first part and a pair of radial pins extending from the second part for engaging and disengaging the recesses. To connect the second part to the first part, the second part is lifted to insert the pins into axially extending portions of the recesses. Then, the second part is rotated to rotate the pins through circumferentially extending portions of the recesses into a locked position. A lock ring is biased downwardly to hold the pins in the locked position. Releasing the second part from the first part requires the reverse operation. Thus, releasing the second part from the first part requires a free hand to lift the lock ring upwardly while the pins are rotated back to an unlocked position. Given the nature of the materials utilized to form the second part, the second part may weigh several pounds. As a result, manipulating the second part with one hand in order to rotate the pins back to the unlocked position, while holding the lock ring with another hand, may be difficult and cumbersome for a single user.

Therefore, there is a need in the prior art for a quick release mechanism that simplifies the connection between the first part and the second part to facilitate servicing the capping units and/or changing out the capping units without requiring excessive manipulating of the second part, which may weigh several pounds.

SUMMARY OF THE INVENTION AND ADVANTAGES

The present invention provides a capping device for fitting caps onto containers. The device includes a spindle for rotating about an operational axis. A connector is releasably coupled to the spindle. The connector is adapted to engage a capping unit for fitting the caps onto the containers. A quick release mechanism operates between a locked position in which the connector is locked to the spindle and an unlocked position in which the connector is releasable from the spindle. The quick release mechanism includes a lock member rotatable relative to the spindle and the connector. The lock member is manually rotated from the locked position to the unlocked position to release the connector from the spindle without requiring any substantially rotation of the spindle or the connector. As a result, the quick release mechanism reduces the amount of manipulation of the spindle or the connector needed to release the connector and capping unit from the spindle when compared to prior art capping devices. Often the connector and capping unit connected thereto weigh several pounds such that manipulation is difficult, but with the quick release mechanism of the present invention, a single user can release the capping unit from the spindle quickly and easily.

In another aspect of the present invention, a biasing member is operatively coupled to the quick release mechanism to urge the quick release mechanism normally in the locked position. The biasing member also operates to automatically move the quick release mechanism from the unlocked position back to the locked position upon re-connecting the connector to the spindle once the connector has been released. Again, since the connector and capping unit connected thereto may weigh several pounds, placement in the spindle may be difficult. With the biasing member urging the quick release mechanism in the locked position, a user simply needs to re-connect the connector to the spindle to automatically lock the connector in the spindle.

A method of releasing the capping unit from the spindle is also provided. The method includes rotating the lock member from the locked position in which the spindle is locked to the capping unit and the unlocked position in which the spindle is unlocked from the capping unit to release the capping unit from the spindle. In this method, the step of rotating the lock member from the locked position to the unlocked position is independent of the capping unit and the spindle such that the quick release mechanism is placed in the unlocked position and the capping unit is removable from the spindle without rotating the capping unit or the spindle.

A method of re-connecting the capping unit to the spindle after releasing the connector from the spindle is also provided. The method includes biasing the lock member from the unlocked position to the locked position. While the lock member is biased, the connector is axially mated to the spindle by the user. Once mated, the quick release mechanism automatically rotates from the unlocked position to the locked position.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 9A is an elevational view of the lock ring, lock sleeve, and drive sleeve with the lock ring in the locked position;

FIG. 9B is an elevational view of the lock ring, lock sleeve, and drive sleeve with the lock ring in the unlocked position;

FIG. 10A is a cross-sectional view of a position pin of the lock sleeve passing through the lock ring with the lock ring in the locked position in a slot in the drive sleeve;

DETAILED DESCRIPTION OF THE INVENTION

Figure 1:
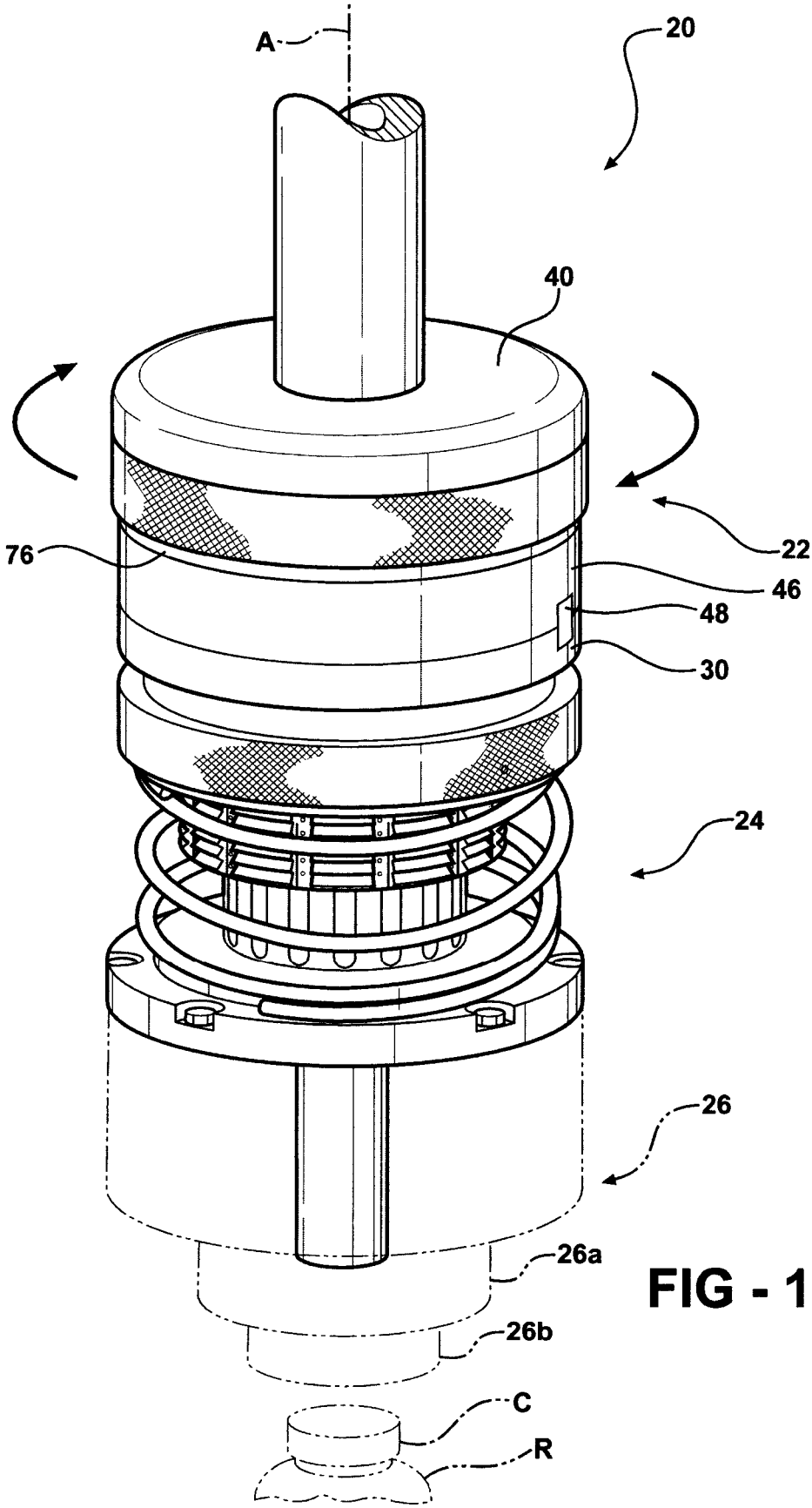
FIG. 1 is a perspective view of a capping device.
Figure 2:
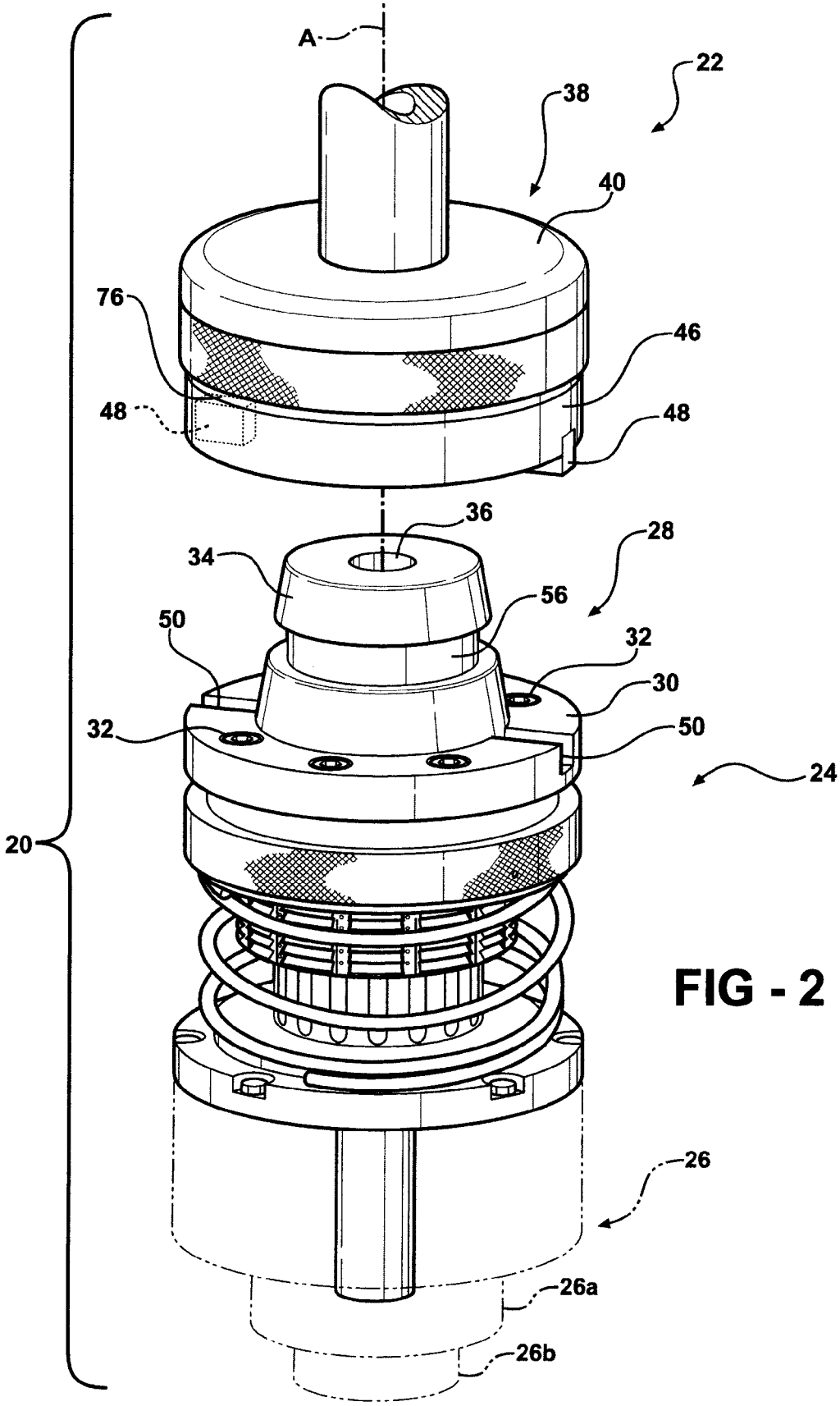
FIG. 2 is another perspective view of the capping device with an upper portion being spaced from a lower portion.

Referring to the Figures wherein like numerals indicate like or corresponding parts throughout the several views, a capping device is generally shown at 20 in FIGS. 1 and 2. The capping device 20 includes an upper portion 22 and a lower portion 24. As discussed in greater detail below, the upper portion 22 mounts to a capping machine (not shown), which imparts rotation to the capping device 10 about an operational axis A via a drive motor, turret assembly, or other drive source. The lower portion 14 has a capping unit 26 (shown in phantom) mounted at a lower end thereof. The capping unit 26 may comprise a clutch 26*a* and a cap-engaging portion 26*b* such as disclosed in U.S. Pat. No. 6,240,678, hereby incorporated by reference. The rotation of the capping device 20 ultimately provides torque to the cap-engaging portion 26*b* in a conventional manner to thread pre-threaded caps C onto containers R as the containers R and the caps C pass through the capping machine.

Referring specifically to FIG. 2, the lower portion 24 of the capping device 20 is removable from the upper portion 22 for servicing and/or for changing the type of capping unit 26 for different applications. The upper portion 24 of the capping device 20 and the manner in which the lower portion 24 quickly connects and disconnects from the upper portion 22 is described below. The lower portion 24 is described in detail in copending application Ser. No. 11/538,722, filed on even date herewith, which is hereby incorporated by reference.

Figure 3:
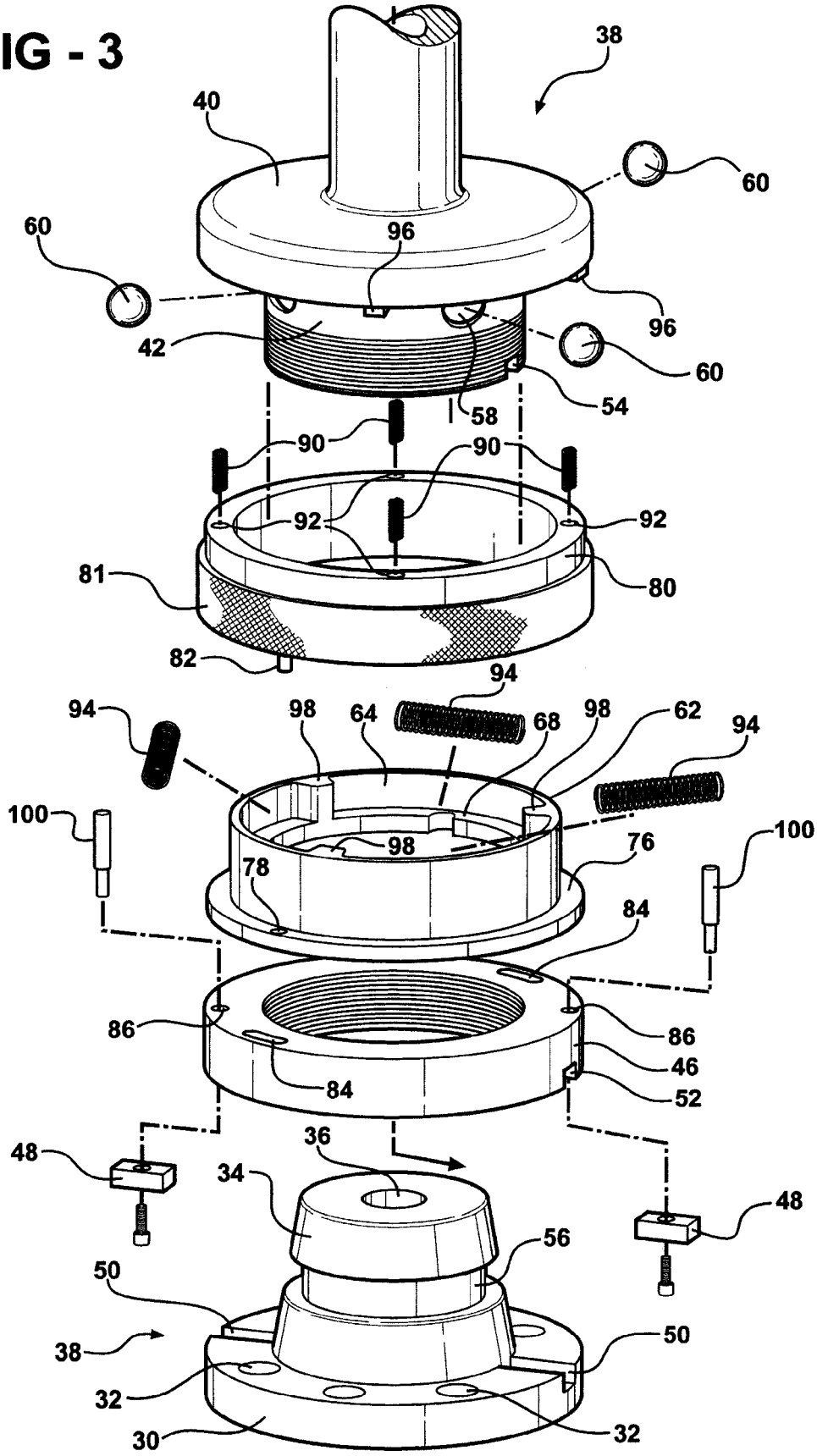
FIG. 3 is an exploded perspective view of the upper portion of FIG. 1 and a connector of the lower portion.

Referring to FIGS. 2 and 3, the lower portion 24 of the capping device 20 includes a connector 28 for inserting into the upper portion 22 to connect the lower portion 24 to the upper portion 22. The connector 28 has a base flange 30 defining a plurality of openings 32 for mounting the remaining components of the lower portion 24 thereto, including the capping unit 26. Thus, the connector 28 supports the capping unit 26 at a lower end thereof. The connector 28 is configured for releasably coupling to the upper portion 22. A tapered body 34 having a through bore 36 is disposed on the base flange 30 and extends upwardly from the base flange 30. The tapered body 34 acts as a male locking portion for engaging the upper portion 22.

The upper portion 22 includes a spindle 38 for rotating about an operational axis A. The spindle 38 is rotated by the capping machine about the operational axis A via the drive motor, turret assembly, or other drive source. The spindle 38 includes an upper flange 40 and an inner sleeve 42 disposed on the upper flange 40 and extending downwardly therefrom. The inner sleeve 42 has a tapered female interior 44, or female locking portion, which is complementary in configuration with the male locking portion of the connector 28 (see FIG. 5A) for releasably mating with the connector 28. More specifically, the tapered body 34 and the inner sleeve 42 have corresponding tapers for aligning and mating the connector 28 to the spindle 38. The tapers are preferably disposed at an acute angle relative to the operational axis A. More preferably, the tapers are disposed from about 1 degree to about 50 degrees relative to the operational axis A, and most preferably from about 10 to about 40 degrees relative to the operational axis A to facilitate the fit between the tapered body 34 and the inner sleeve 42. In one embodiment, the tapers are disposed at 30 degrees relative to the operational axis A.

Referring specifically to FIG. 3, a drive sleeve 46 is fixed to the inner sleeve 42 of the spindle 38 to rotate with the spindle 38 during use. The drive sleeve 46 is connected to the spindle 38 by a threaded connection and then the drive sleeve 46 and spindle 38 are locked together by a pair of drive keys 48. More specifically, the drive sleeve 46 includes a pair of opposing upper channels 52 (only one shown) defined in a lower surface thereof and the spindle 38 has a pair of opposing notches 54 (only one shown) defined at a bottom of the inner sleeve 42. The upper channels 52 and notches 54 are aligned to receive the drive keys 48 to lock the drive sleeve 46 to the spindle 38.

Figure 4:
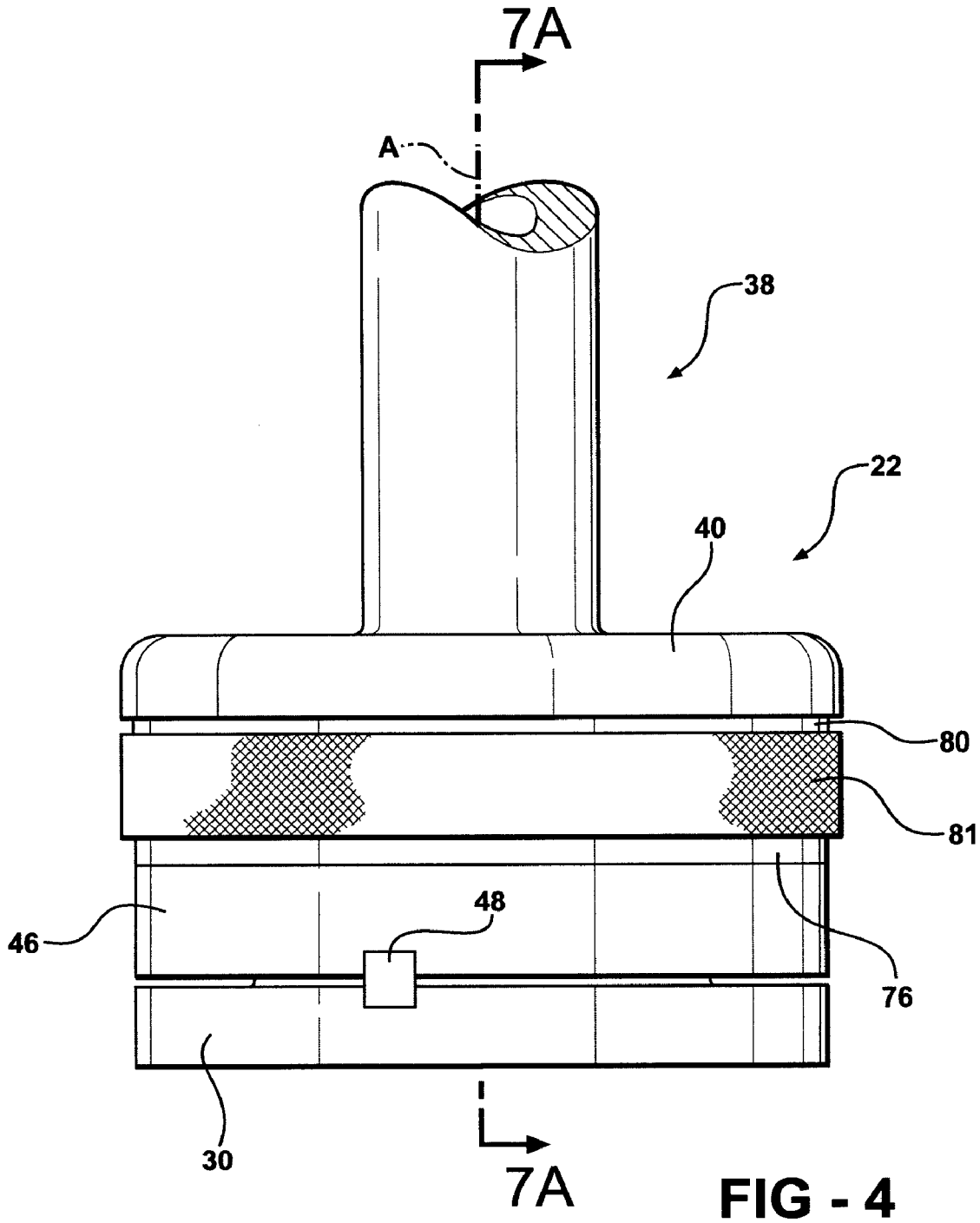
FIG. 4 is a side view of the upper portion of the capping device and the connector of FIG. 3.

Referring to FIGS. 3 and 4, the drive keys 48 act as a rotation coupling to rotatably fix the connector 28 to both the spindle 38 and the drive sleeve 46 when the tapered body 34 is mated to the inner sleeve 42. The connector 28 includes a pair of opposing lower channels 50 defined in the base flange 30. The drive keys 48 mate with the lower channels 50 when the tapered body 34 mates to the inner sleeve 42. The drive keys 48 fit snugly within the lower channels 50 to transfer rotation from the spindle 38 of the upper portion 22 to the connector 28 of the lower portion 24.

Figure 5A:
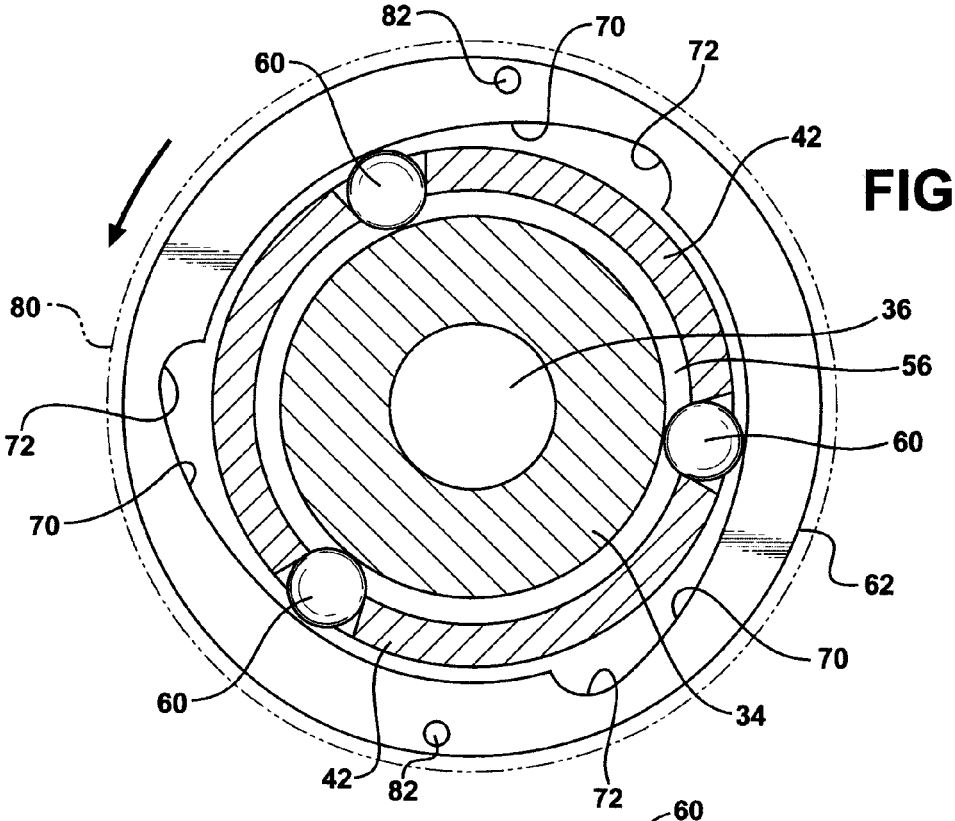
FIG. 5A is a cross-sectional view of the lower portion and connector taken generally along the line 5A-5A in FIG. 7A with the lock ring in the locked position.
Figure 5B:
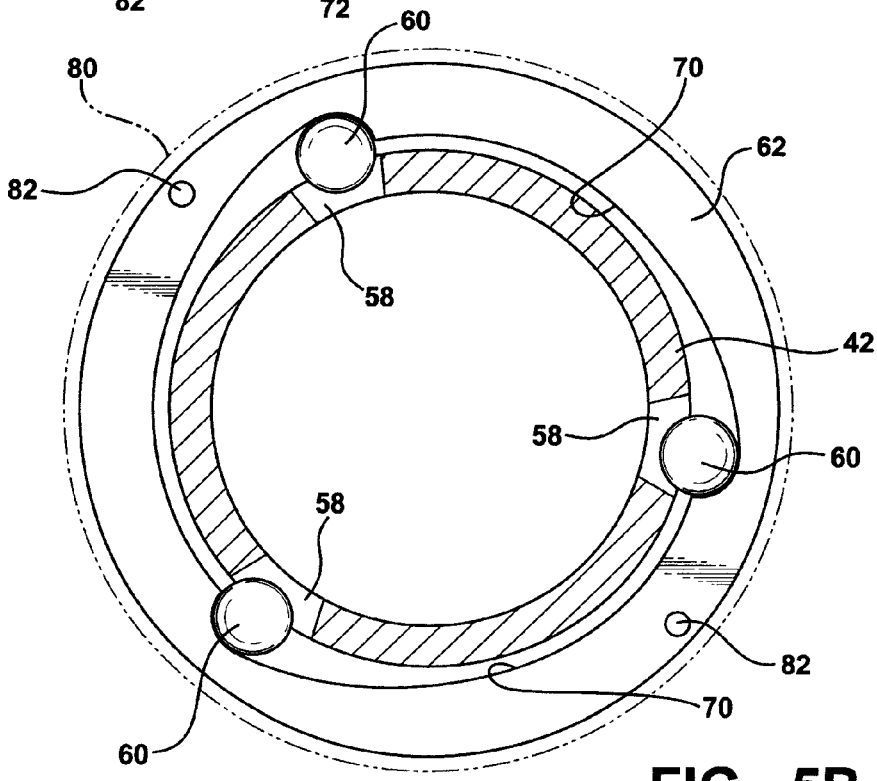
FIG. 5B is a cross-sectional view of the lower portion taken generally along the line 5B-5B in FIG. 7B with the lock ring in the unlocked position.

Referring to FIGS. 3, 5A, and 5B, an axial locking mechanism axially locks the connector 28 to the spindle 38. The axial locking mechanism includes an annular locking groove 56 defined in the tapered body 34 of the connector 28 and a plurality of cavities 58 defined in the inner sleeve 42 of the spindle 38. Preferably, the axial locking mechanism includes three or more cavities 58. The cavities 58 are preferably positioned at the same elevation in the inner sleeve 42 with about 120 degrees of radial separation from center to center. The axial locking mechanism further includes a plurality of ball bearings 60. When the connector 28 is axially locked in the spindle 38, the ball bearings 60 are disposed partially through the cavities 58 and snugly in the locking groove 56 about the tapered body 34 to secure the connector 28 to the spindle 38 (see FIG. 5A). On the other hand, the ball bearings 60 are free to move out from the locking groove 56 back through the cavities 58 when the connector 28 is axially unlocked from the spindle 38 thereby allowing the connector 28 to be released from mating engagement with the spindle 38 (see FIG. 5B). The cavities 58 partially house the ball bearings 60 in both the locked and unlocked positions. The ball bearings 60 move within the cavities 58 between the locked and unlocked positions. The cavities 58 are preferably tapered to prevent the ball bearings 60 from passing entirely through the cavities 58 to thereby retain the ball bearings 60 on an outside of the inner sleeve 42. In particular, the cavities 58 are configured such that only about a third of the ball bearings 60 can extend through the cavities 58 into the locking groove 56.

Referring to FIGS. 3, 4, 5A, and 5B, a quick release mechanism operates between the locked position (see FIG. 5A) to axially lock the connector 28 to the spindle 38 and the unlocked position (see FIG. 5B) to release the connector 28 from the spindle 38. More specifically, the quick release mechanism moves the ball bearings 60 into the locking groove 56 in the locked position and allows the ball bearings 60 to move out from the locking groove 56 in the unlocked position.

The quick release mechanism includes a lock member 62, in the form of an annular lock ring 62. The lock ring 62 is disposed about the inner sleeve 42 of the spindle 38 between the upper flange 40 of the spindle 38 and the drive sleeve 46. The lock ring 62 is rotatable relative to the spindle 38 and the connector 28. The lock ring 62 is manually rotated from the locked position to the unlocked position to release the connector 28 from the spindle 38 without substantially rotating the spindle 38 or the connector 28. In addition, the lock ring 62 automatically rotates back from the unlocked position to the locked position to secure the connector 28 in the spindle 38 upon re-connecting the connector 28 to the spindle 38 without substantially rotating the spindle 38 or the connector 28. This auto-locking feature is described further below.

Figure 6A:
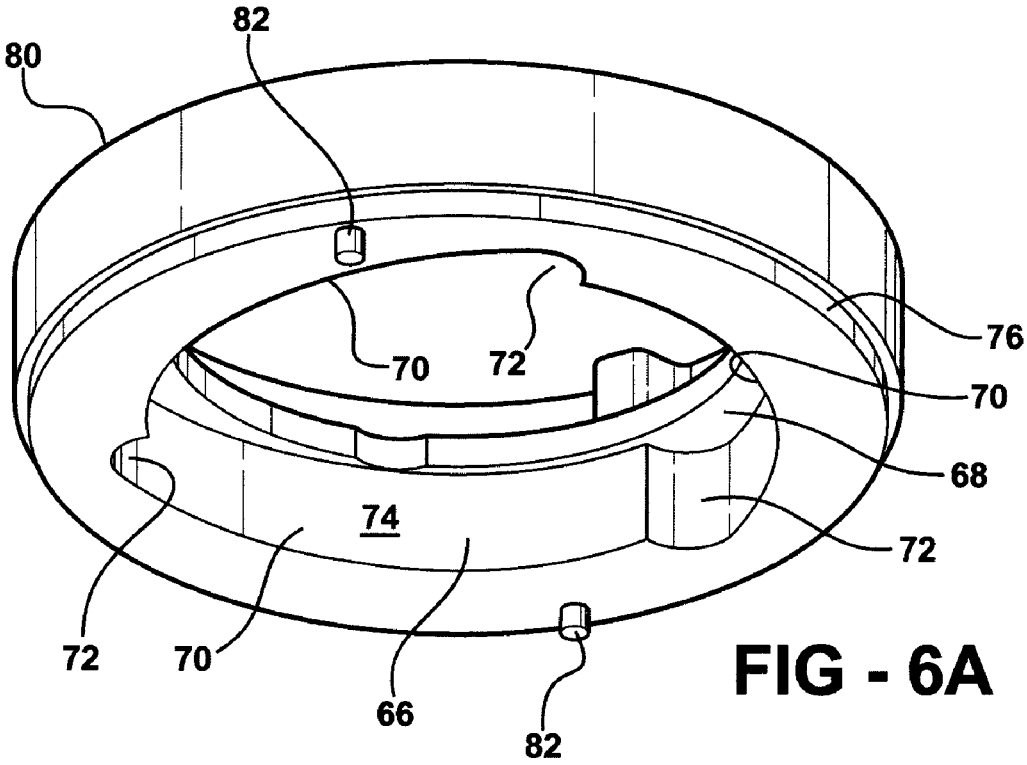
FIGS. 6A and 6B are perspective views of a lock ring and gripper sleeve of the quick release mechanism of the present invention with the gripper sleeve being in a rest position and a release position, respectively.
Figure 6B:
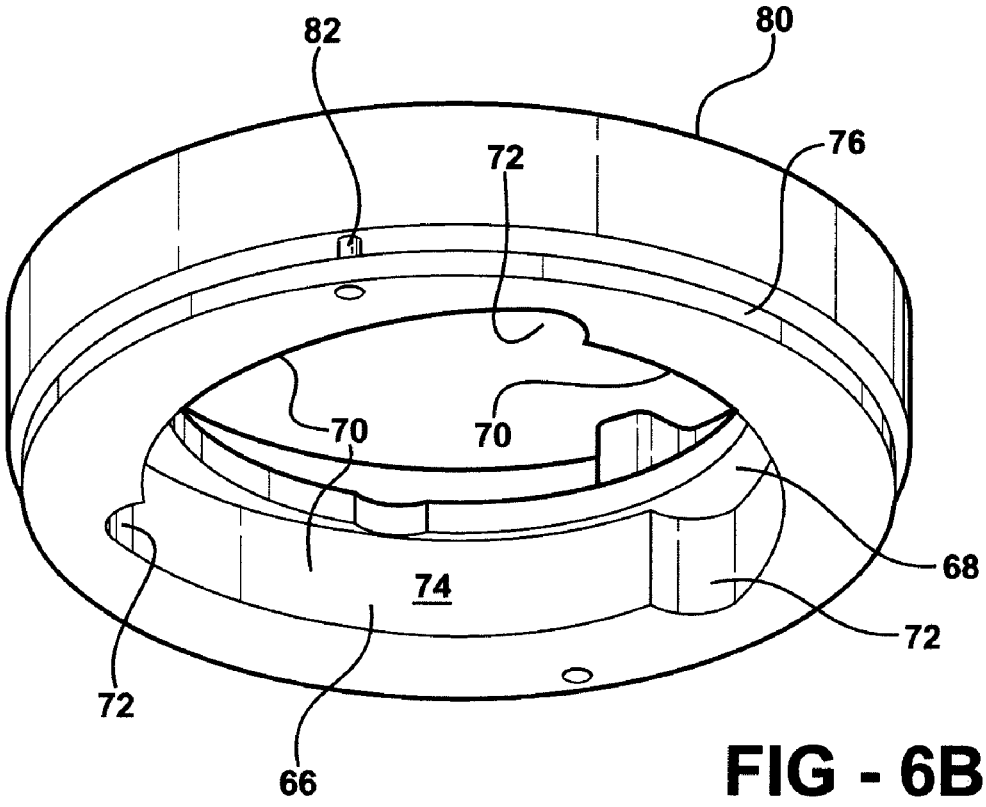

Referring to FIGS. 3, 6A, and 6B, the lock ring 62 includes upper 64 and lower 66 chambers, which are separated by an annular partition 68. The lower chamber 66 of the lock ring 62, best shown in FIGS. 6A and 6B, includes a series of ramped portions 70 each terminating into a pocket 72 for receiving the ball bearings 60 in the unlocked position. The ball bearings 60 ride along the ramps during the rotational movement of the lock ring 62. The ramped portions 70 urge the plurality of ball bearings 60 through the plurality of cavities 58 into the locking groove 56 defined in the tapered body 34 in the locked position. More specifically, each of the ramped portions 70 have a camming surface 74 to urge the plurality of ball bearings 60 through the plurality of cavities 58 into the locking groove 56 when the lock ring 62 is in the locked position. In FIG. 5A, the lock ring 62 is shown in the locked position with the ramped portions 70 urging the ball bearings 60 into the locking groove 56. In FIG. 5B, the lock ring 62 has been rotated to the unlocked position and the ball bearings 60 are now aligned with the pockets 72 such that the ball bearings 60 are free to move into the pockets 72 from the locking groove 56 to release the connector 28 from the spindle 38.

The lock ring 62 includes an outwardly extending rim 76 with a pair of through openings 78. The quick release mechanism also includes a lock sleeve 80 in rotational registration with the lock ring 62 such that rotation of the lock sleeve 80 rotates the lock ring 62. More specifically, the lock sleeve 80 includes a pair of positioning pins 82 fixed to the lock sleeve 80. The positioning pins 82 extend downwardly from the lock sleeve 80 into the through openings 78 such that rotation of the lock sleeve 80 results in rotation of the lock ring 62. The lock sleeve 80 includes a textured outer surface 81 to facilitate grasping by a user to lift and rotate the lock sleeve 80 manually from the locked position to the unlocked position.

Referring specifically to FIG. 3, the drive sleeve 46 defines a first 84 and second 86 pair of apertures. The first pair of apertures 84 are further defined as lock slots 84 formed in an upper surface of the drive sleeve 46. The second pair of apertures 86 are further defined as release holes 86 with a counterbore 88 (see FIG. 10C) defined through the drive sleeve 46. When the lock sleeve 80 engages the lock ring 62, the positioning pins 82 protrude through the through openings 78 of the lock ring 62, such as shown in FIG. 6A. The positioning pins 82 register with the lock slots 84 in the locked position and with the release holes 86 in the unlocked position. The lock sleeve 80 is manually rotatable to rotate the lock ring 62 about the spindle 38 and move the positioning pins 82 from the lock slots 84 to the release holes 86 to place the lock ring 62 in the unlocked position and release the connector 28 from the spindle 38. A pair of trip pins 100 rest in the release holes 86 for purposes described further below.

Figure 7A:
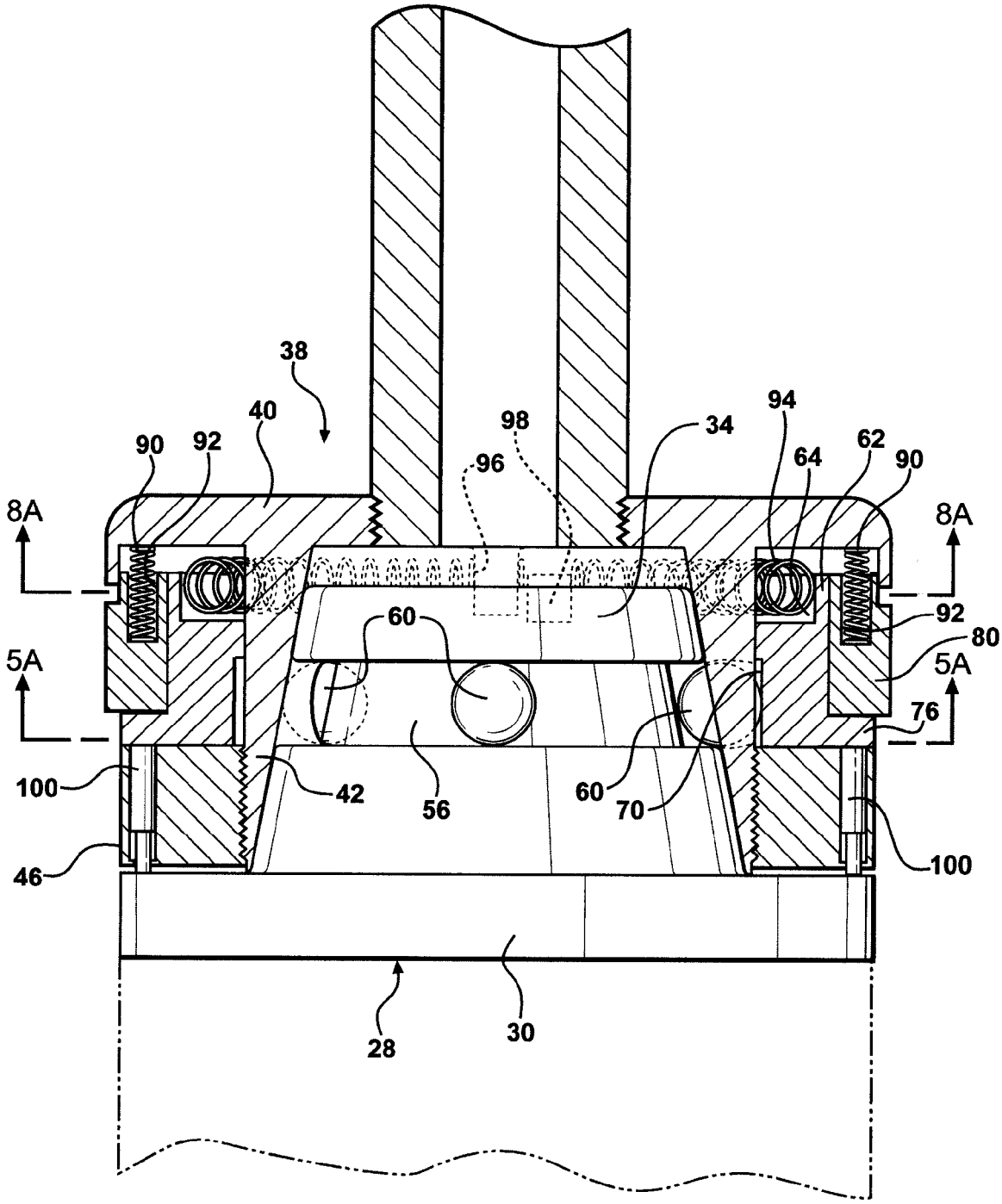
FIG. 7A is a cross-sectional view of the upper portion of the capping device and the connector taken generally along the line 7A-7A in FIG. 4 with a lock ring being in a locked position.

Referring to FIGS. 3 and 7A, a plurality of sleeve springs 90 rest in spring pockets 92 formed in the lock sleeve 80. The sleeve springs 90 act between the upper flange 40 of the spindle 38 and the lock sleeve 80 to bias the lock sleeve 80 downwardly thereby biasing the positioning pins 82 into the lock slots 84 in the locked position and into the release holes 86 in the unlocked position. The sleeve springs 90 interact between the spindle 38 and the lock sleeve 80 to continuously bias the lock sleeve 80 against the rim 76 of the lock ring 62. The lock ring 62 and lock sleeve 80 are shown in the locked position in FIG. 7A and in the unlocked position in FIG. 7B.

Referring to FIGS. 7A, 7B, 8A, and 8B, a plurality of biasing members 94, preferably compression springs, hereinafter referred to as lock springs 94, are operatively coupled to the lock ring 62. The lock springs 94 urge the lock ring 62 in the locked position. More specifically, the lock springs 94 act between the spindle 38 and the lock ring 62 to urge the lock ring 62 normally in the locked position. The lock springs 94 are disposed in the upper chamber 64 and rest on the partition 68. The lock springs 94 automatically move the lock ring 62 from the unlocked position to the locked position upon re-connecting the connector 28 back to the spindle 38 after releasing the connector 28 from the spindle 38.

The spindle 38 includes a first plurality of abutment members 96 disposed radially about the operational axis A. Similarly, the lock ring 62 includes a second plurality of abutment members 98 disposed radially about the operational axis A in the upper chamber 64 of the lock ring 62. Each of the plurality of lock springs 94 act between one of the first plurality of abutment members 96 and one of the second plurality of abutment members 98 to urge the lock ring 62 in the locked position. During rotation of the lock ring 62 from the locked position (FIG. 8A) to the unlocked position (FIG. 8B), the first plurality of abutment members 96 of the spindle 38 remain stationary such that the lock springs 94 are compressed through the rotational movement of the first plurality of abutment members 96 of the lock ring 62. The compression of the lock springs 94 continuously biases the lock ring 62 to return to the locked position. Portions of the lock springs 94, abutment members 96, 98, and ball bearings 60 are shown in phantom in FIGS. 7A and 7B for illustrative purposes. No other hidden members are shown for clarity.

Figure 10B:
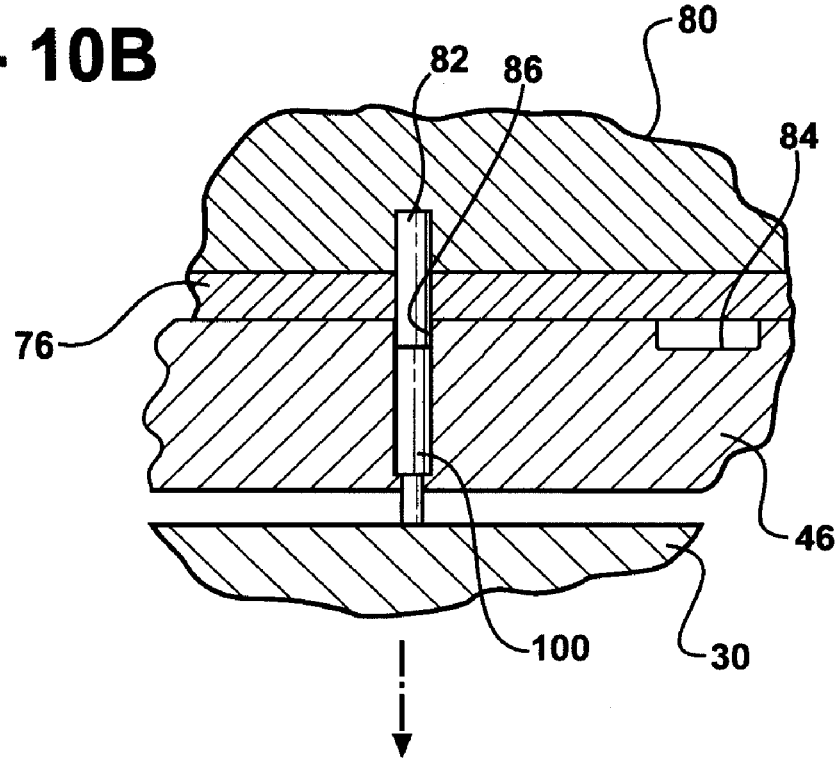
FIG. 10B is a cross-sectional view of the position pin of the lock sleeve passing through the lock ring after a user has rotated the lock sleeve and lock ring to move the position pin from the slot in the drive sleeve to a through bore in the drive sleeve on top of a trip pin to release the connector.

Referring to FIGS. 9A through 10B, when it is desirable to release the lower portion 24 from the upper portion 22, i.e., to release the connector 28 from the spindle 38, the lock sleeve 80 and lock ring 62 are moved from the locked position shown in FIGS. 9A and 10A to the unlocked position shown in FIGS. 9B and 10B. In particular, the lock sleeve 80 is lifted upwardly against the biasing force of the sleeve springs 90 such that the positioning pins 82 are retracted from the lock slots 84 into the rim 76 of the lock ring 62, as shown in FIG. 6B. The lock sleeve 80 and lock ring 62 are then manually rotated in preferably a counterclockwise direction toward the release holes 86 by grasping and rotating the lock sleeve 80. Once the positioning pins 82 align with the release holes 86, the positioning pins 82 are biased by the sleeve springs 90 into the release holes 86 (see FIGS. 9B and 10B). The positioning pins 82 engage the trip pins 100 disposed within the release holes 86 of the drive sleeve 46. A bottom of the trip pins 100 impacts a top surface of the base flange 30 of the connector 28 to push the connector 28 away from the spindle 38 and assist in removing the lower portion 24 from the upper portion 22. The lock slots 84, release holes 86, positioning pins 82, and trip pins 100 are shown in phantom in FIGS. 9A and 9B for illustrative purposes. No other hidden members are shown for clarity.

Figure 10C:
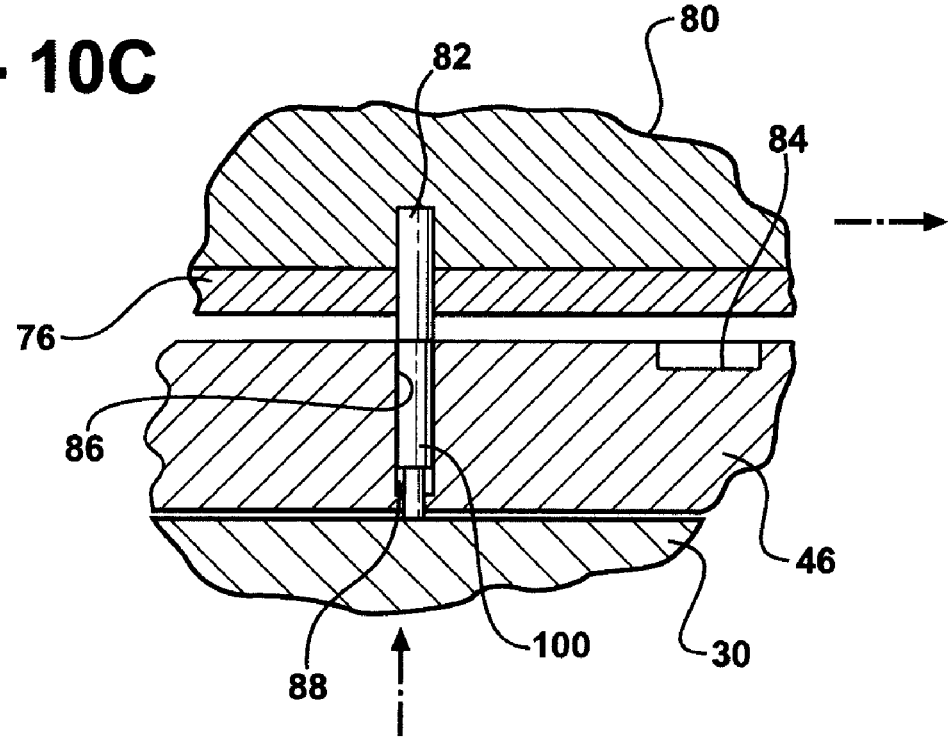
FIG. 10C is a cross-sectional view of the position pin of the lock sleeve passing through the lock ring after the user has replaced the connector into the upper portion thereby pushing the trip pin upwardly and displacing the position pin from the through bore to automatically spring back to the slot in the drive sleeve.

Referring specifically to FIG. 10C, when the lower portion 24 is mounted back to the upper portion 22, i.e., the connector 28 is re-connected back to the spindle 38, the reverse operation occurs. In particular, the top surface of the base flange 30 of the connector 28 impacts the trip pins 100 and moves the trip pins 100 upwardly within the release holes 86 of the drive sleeve 46 to engage and push the positioning pins 82 out of the release holes 86. The lock sleeve 80 and lock ring 62 then automatically return to the locked position under the bias of the lock springs 94. The positioning pins 82 then fall back into the lock slots 84 and the lock sleeve 80 and lock ring 62 have thus returned to the locked position thereby securing the lower portion 24 to the upper portion 22.

Figure 7B:
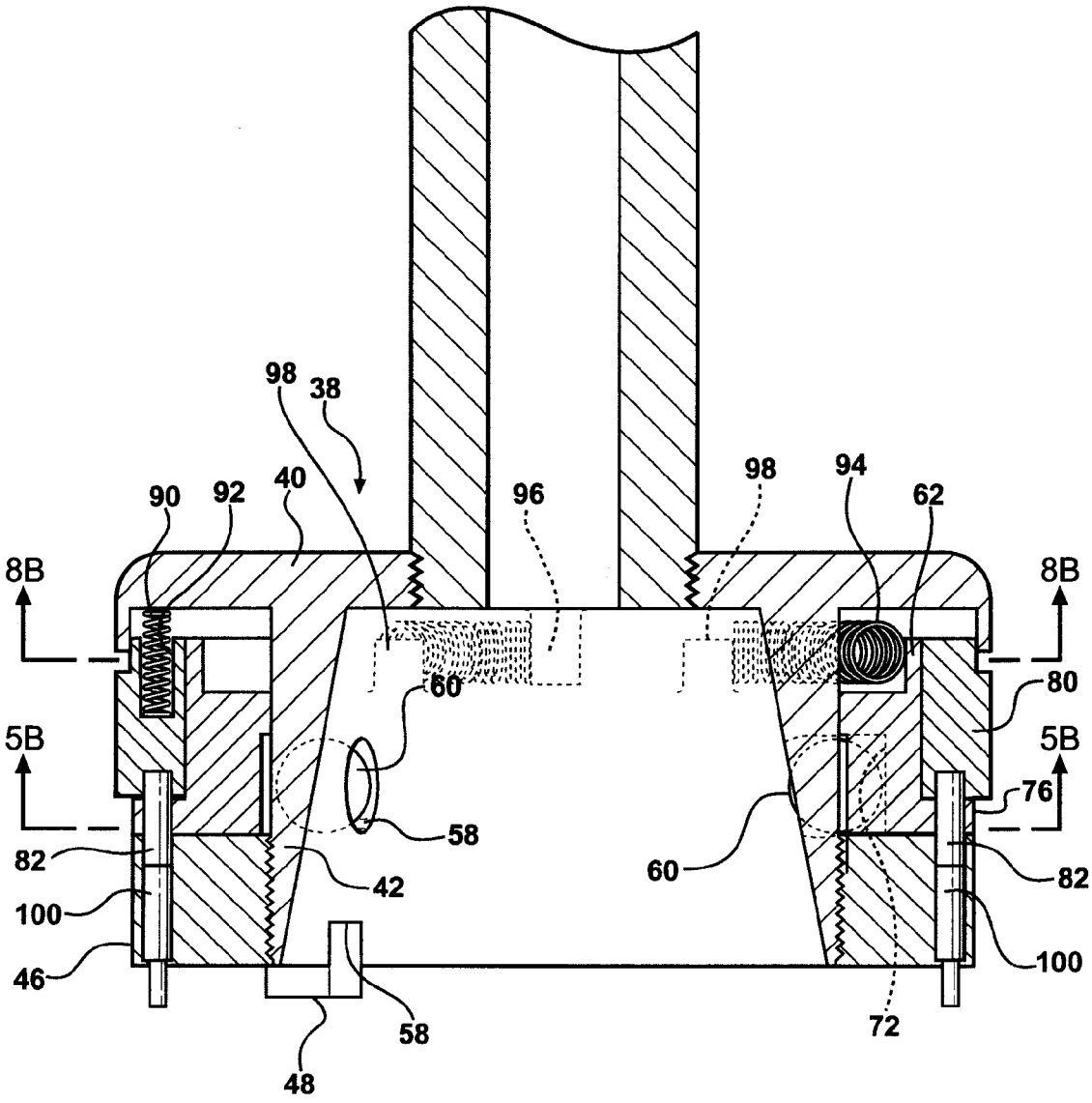
FIG. 7B is a cross-sectional view of the upper portion of the capping device taken generally along the line 7A-7A in FIG. 4, but with the lock ring being in the unlocked position and the connector removed from the upper portion.
Figure 8A:
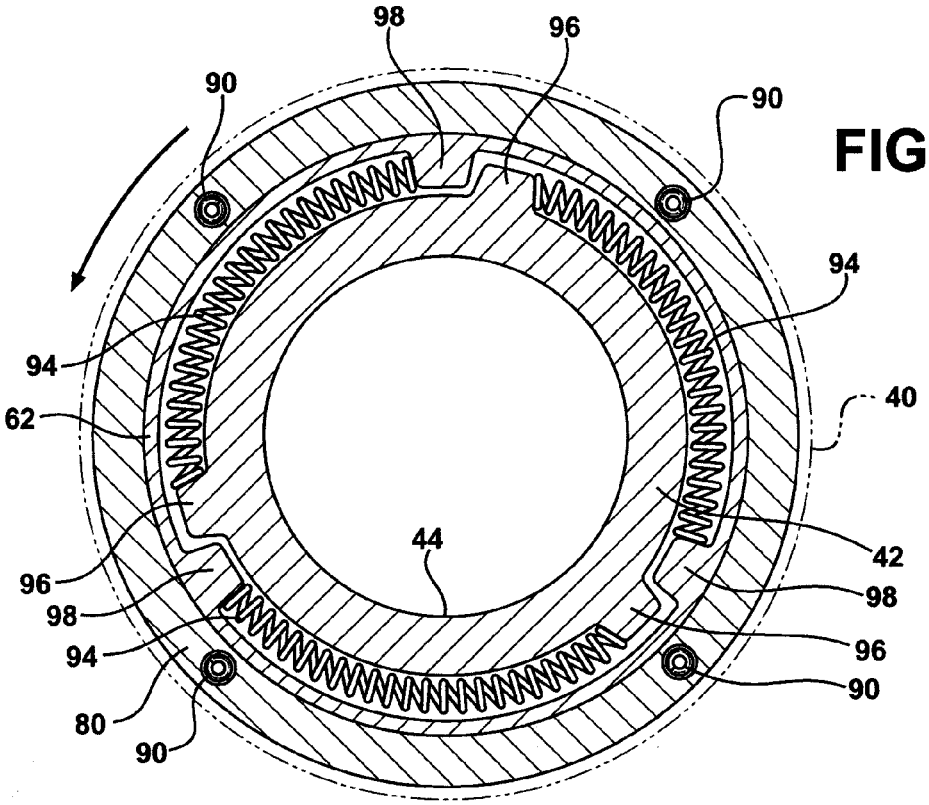
FIG. 8A is a cross-sectional view of the lower portion taken generally along the line 8A-8A in FIG. 5A with the lock ring in the locked position.
Figure 8B:
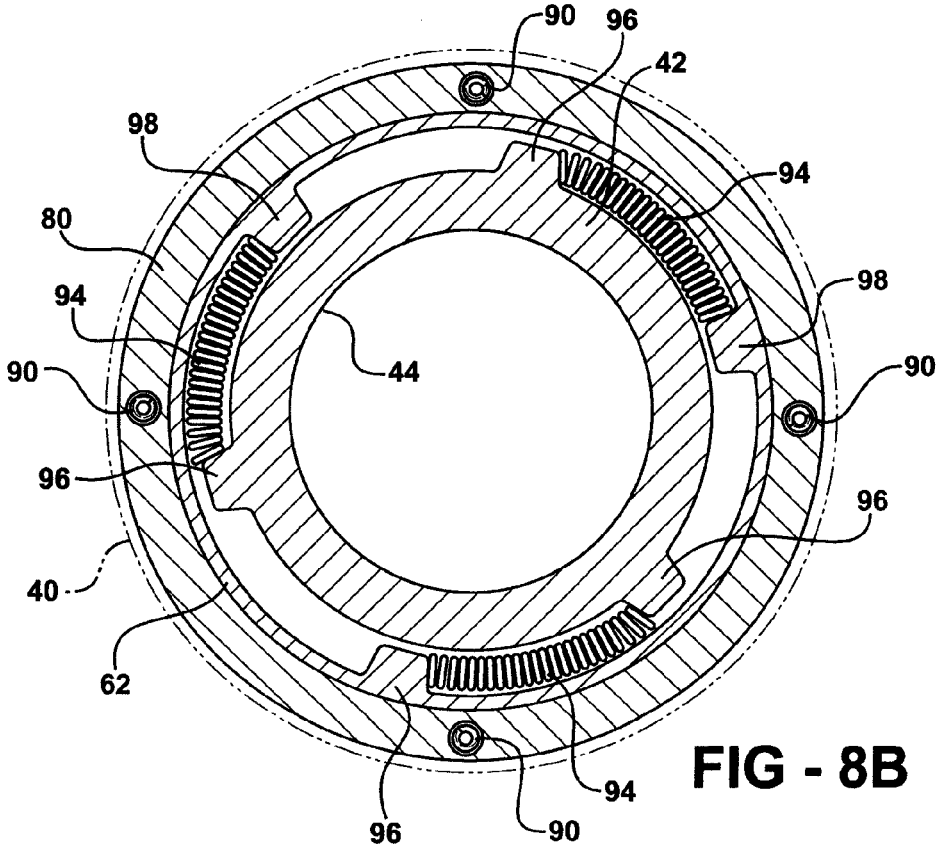
FIG. 8B is a cross-sectional view of the lower portion taken generally along the line 8B-8B in FIG. 5B with the lock ring in the unlocked position.

As discussed above, the upper portion 22 is intended to be secured to the capping machine. In one embodiment, as shown in FIGS. 7A and 7B, the spindle 38 may have a female threaded section for receiving a rotating shaft of the capping machine in order to fully secure the upper portion 22 to the capping machine. The quick release mechanism and lock springs 94 therefore provide a quick and easy disassembly of the lower portion 24 of the capping device 20 from the capping machine in order to service and/or change the lower portion 24, including the capping unit 26. In particular, the user simply rotates a locking subassembly, which includes the lock sleeve 80 and lock ring 62, counterclockwise to release the ball bearings 60 from the locking groove 56 of the connector 28. The lower portion 24 is then released from the upper portion 22. To reinstall the lower portion 24 to the upper portion 22, the user simply aligns the tapered body 34 of the connector 28 with the correspondingly shaped female interior 44 of the spindle 38 and the locking subassembly automatically rotates back into the locked position, which secures the ball bearings 60 in the locking groove 56.

Preferably, each of the above-described components are formed of metal or metal alloys such as stainless steel, aluminum, and the like. Other suitable materials may also be used to form these components.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A capping device for fitting caps onto containers, comprising;

a spindle for rotating about an operational axis, a connector releasably coupled to said spindle and adapted to support a capping unit for fitting the caps onto the containers, a quick release mechanism operable between a locked position in which said connector is locked to said spindle and an unlocked position in which said connector is releasable from said spindle, said quick release mechanism including a lock member manually rotatable relative to said spindle and said connector from said locked position to said unlocked position to release said connector from said spindle without substantially rotating said spindle or said connector, and a positioning mechanism coupled to said lock member for holding said lock member in said unlocked position after said lock member is manually rotated from said locked position to said unlocked position.

2. The device as set forth in claim 1 wherein said connector includes a male portion defining an annular groove.

3. The device as set forth in claim 2 wherein said spindle includes a female portion defining a plurality of cavities, said female portion adapted for receiving said male portion of said connector.

4. The device as set forth in claim 3 wherein said male and female portions have complimentary tapers for aligning and mating said male portion with said female portion.

5. The device as set forth in claim 3 including a plurality of ball bearings disposed in said plurality of cavities of said female portion.

6. The device as set forth in claim 5 wherein said plurality of ball bearings are urged through said plurality of cavities into said groove defined in said male portion in said locked position.

7. The device as set forth in claim 6 wherein said lock member is further defined as a lock ring including a plurality of ramped portions having a camming surface for urging said plurality of ball bearings through said plurality of cavities into said groove when said lock ring is in said locked position.

8. The device as set forth in claim 7 wherein each of said plurality of ramped portions ends in a pocket for receiving said ball bearings in said unlocked position.

9. The device as set forth in claim 1 including a drive member fixed to said spindle for rotating with said spindle about said operational axis wherein said drive member defines a first and second aperture.

10. The device as set forth in claim 9 wherein said lock member is further defined as a lock ring and said positioning mechanism includes a lock sleeve and a positioning pin fixed to said lock sleeve, said positioning pin being in rotational registration with said lock ring such that rotation of said lock sleeve rotates said lock ring.

11. The device as set forth in claim 10 wherein said positioning pin registers with said first aperture in said locked position and with said second aperture in said unlocked position whereby said lock sleeve is manually rotatable to rotate said lock ring and move said positioning pin from said first aperture to said second aperture to place said lock ring in said unlocked position and release said connector from said spindle.

12. The device as set forth in claim 11 including a spring biasing said lock sleeve downwardly thereby biasing said positioning pin into said first aperture in said locked position and into said second aperture in said unlocked position.

13. The device as set forth in claim 11 including a pair of said positioning pins, a pair of said first apertures in the shape of elongated grooves for receiving said positioning pins in said locked position, and a pair of said second apertures for receiving said positioning pins in said unlocked position.

14. The device as set forth in claim 11 including a biasing member acting between said spindle and said lock ring for urging said lock ring normally in said locked position and for automatically moving said lock ring from said unlocked position to said locked position upon re-connecting said connector to said spindle.

15. The device as set forth in claim 14 including a plurality of said biasing members acting between said spindle and said lock ring for urging said lock ring normally in said locked position and for automatically moving said lock ring from said unlocked position to said locked position upon re-connecting said connector to said spindle.

16. The device as set forth in claim 15 wherein said spindle includes a first plurality of abutment members disposed radially about said operational axis and said lock ring includes a second plurality of abutment members disposed radially about said operational axis with each of said plurality of biasing members acting between one of said first plurality of abutment members and one of said second plurality of abutment members to urge said lock ring in said locked position.

17. The device as set forth in claim 14 including a trip pin sitting in said second aperture whereby said connector impacts said trip pin and said trip pin pushes said positioning pin out of said second aperture upon mating said connector with said spindle, said biasing member automatically urging said lock ring back to said locked position upon said positioning pin being pushed from said second aperture by said trip pin.

18. The device as set forth in claim 1 including a rotation coupling interconnecting said spindle and said connector to lock rotation of said connector with said spindle.

19. The device as set forth in claim 18 wherein said rotation coupling includes at least one channel defined in each of said spindle and said connector and at least one key disposed in said channels to rotatably fix said connector to said spindle.

* * * * *